United States Patent [19]

Baggermans

[11] 4,086,552

[45] Apr. 25, 1978

[54] HIGH-VOLTAGE TRANSFORMER COMPRISING A FOIL WINDING

[75] Inventor: Albertus Bernardus Antonius Baggermans, Eindhoven, Netherlands

[73] Assignee: U.S. Philips Corporation, New York, N.Y.

[21] Appl. No.: 771,695

[22] Filed: Feb. 24, 1977

Related U.S. Application Data

[63] Continuation of Ser. No. 623,315, Oct. 17, 1975, abandoned.

[30] Foreign Application Priority Data

Oct. 21, 1974 Netherlands ..... 7413744

[51] Int. Cl.[2] ..... H01F 21/04

[52] U.S. Cl. ..... 336/119

[58] Field of Search ..... 336/223, 232, 96, 220, 336/221, 117, 118, 119, 129, 180; 334/71, 74–76, 77; 323/52, 53, 90

[56] References Cited

U.S. PATENT DOCUMENTS

| | | | |
|---|---|---|---|
| 1,684,746 | 9/1928 | Smith et al. | 336/119 X |
| 2,572,455 | 10/1951 | Dunn | 336/119 |
| 3,360,754 | 12/1967 | Gerdiman | 336/223 X |
| 3,448,340 | 6/1969 | Lewis | 336/223 X |
| 3,548,357 | 12/1970 | Peckham | 336/96 X |
| 3,750,071 | 7/1973 | Eley | 336/232 X |

*Primary Examiner*—Thomas J. Kozma

*Attorney, Agent, or Firm*—Frank R. Trifari; Henry I. Steckler

[57] ABSTRACT

The low-voltage winding of a line transformer consists of a foil winding. In order to tune the line transformer to the third or the fifth harmonic, the coupling factor is adjusted by sliding the high-voltage winding with respect to the low-voltage winding. The length of the leg of the core whereabout the low-voltage winding and the high-voltage winding are arranged substantially exceeds the width of the low-voltage winding. The high-voltage winding can be partly slid beyond the head face of the low-voltage winding, with the result that the coupling factor is reduced.

2 Claims, 2 Drawing Figures

HIGH-VOLTAGE TRANSFORMER COMPRISING A FOIL WINDING

Figure 1:
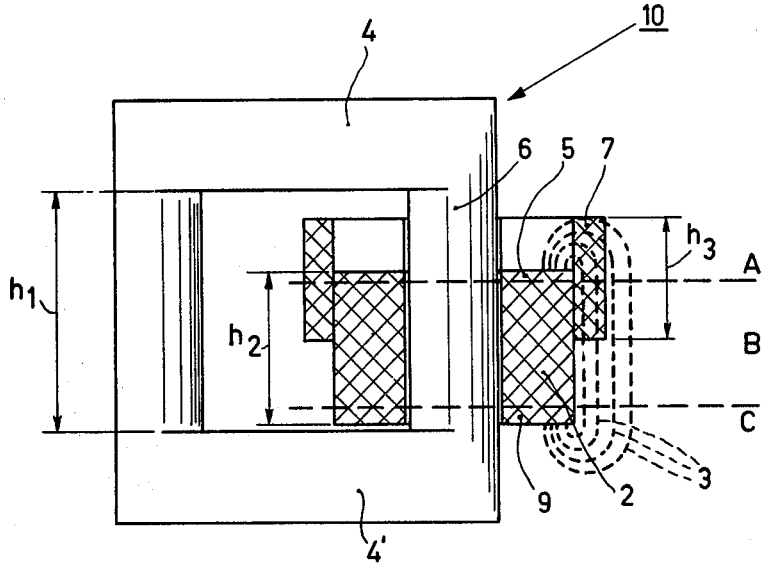

This is a continuation of application Ser. No. 623,315, filed Oct. 17, 1975, now abandoned.

The invention relates to a high-voltage transformer, notably a line transformer for a television receiver, comprising a ferromagnetic core which consists of two yokes which are interconnected by two legs, at least one low-voltage winding which encloses one of the legs, and one high-voltage winding which is arranged on the low-voltage winding.

It is to be noted that the terms low-voltage winding, high-voltage winding and other windings as used above and hereinafter always refer solely to the conductive portion of what is normally referred to as a "winding".

A high-voltage transformer of this kind is known from the magazine Funk-Technik, 1974, No. 11, page 396 and further.

Windings of a high-voltage transformer are usually made of brass-wire. It was found to be advantageous to make transformer windings of metal foil. Only a comparatively low voltage is then present between the successive conductive foil layers, with the result that the insulating layer between the successive foil layers must satisfy only minimum requirements. Furthermore, tappings can be made substantially simpler in the case of foil windings than in the case of wire windings. This is notably important for the low-voltage winding of a line transformer for a television receiver, because therefrom an increasing number of voltages which are elsewhere required in the receiver are tapped.

From the said article it is also known to obtain an as high as possible yield from a line transformer by tuning to the third or fifth harmonic. Tuning can be effected by making the coupling factor, determining the magnetic coupling between the transformer windings, adjustable. It is known that in wire-wound transformers the coupling factor can be changed by axial displacement of the high-voltage winding with respect to the low-voltage winding. Due to the displacement of the high-voltage winding, the field generated by the low-voltage winding is enclosed more or less by the high-voltage winding than before displacement of the latter. This constitutes the variation of the coupling factor. Foil-wound transformers have a deviating magnetic stray field with respect to wire-wound transformers, so that for foil transformers the same adjustability of the coupling factor cannot be obtained without further steps being taken.

The invention is based on the recognition of the difference in the build-up of the magnetic stray field of the foil winding and that of a wire winding. Due to the distance between the wires of a winding layer which is necessary for insulation, the field lines of the neighbouring magnetic field are curved more on the side of a wire winding than the field lines on the side of a foil winding, because the field lines are parallel to the conductive closed surface of the foils. The field lines of the magnetic field of a foil winding, however, are substantially curved at the end face of the winding.

In order to realize a high-voltage transformer which offers the advantages of a foil winding and which is also tunable in the described manner, the invention is characterized in that the low-voltage winding is a foil winding, the length of the leg whereabout the low-voltage winding and the high-voltage winding are arranged being substantially larger than the width of the foil winding.

The invention will be described in detail hereinafter with reference to a drawing.

Figure 2:
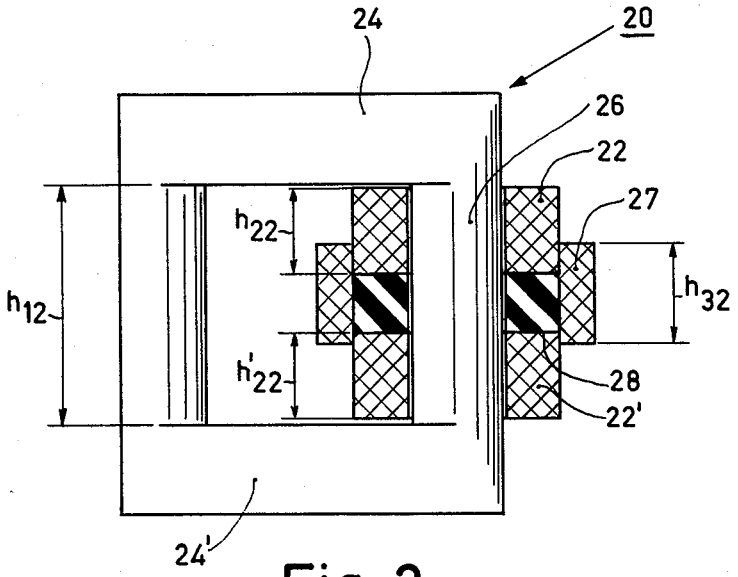

FIG. 1 is a diagrammatic view of a preferred embodiment of a high-voltage transformer according to the invention, and FIG. 2 is a diagrammatic view of a further embodiment of a high-voltage transformer according to the invention.

In FIG. 1, a foil winding 2 is arranged about a core 10. The layers of the winding 2 are insulated from each other by an insulating tape of synthetic material, for example, a Mylar foil which is to be wound simultaneously with a conductive foil. The neighbouring field lines 3 of the magnetic field generated by the winding 2 are substantially curved near the head 5 of the winding 2 (in the area A), extend approximately parallel to the winding 2 in the area B, and are substantially curved again on the lower end 9 of the winding 2 (in the area C). Because the foil used in the winding 2 forms an uninterrupted conductive surface, the field lines in the central portion B must extend parallel to the winding 2. In the areas A and C, the field lines must be substantially curved, because the field lines 3 in the insulating layers of the winding 2 (not shown) also extend parallel to the winding 2. The axial displacement of a high-voltage winding 7 along the foil winding 2 would cause hardly any change in the magnetic field enclosed by the high-voltage winding 7 if the low voltage winding 2 were to have a width approximating the length of the leg 6. The arrangement shown and the dimensions of the various components of the high-voltage transformer enable the coupling factor to be adjusted within reasonable limits. The width $h2$ of the aluminium foil of the winding 2 is substantially smaller than the distance $h1$ between the two yokes 4 and 4' of the core 1.

When the high-voltage winding 7 in FIG. 1 is slid from the sector B into the sector A, a different intersection of the field lines 3, and hence a different enclosure of the magnetic field, is obtained, with the result that the coupling factor can be adjusted within given limits.

FIG. 2 diagrammatically shows a second embodiment of a line transformer 20. About a leg 26 there is arranged a foil winding which consists of two portions 22 and 22'. The two portions 22 and 22' are simultaneously wound in a Mylar foil. The central portion 28 about the leg 26 is free from conductive material and merely consists of insulating foil. The two portions 22 and 22' can be connected in series as well as in parallel. The line transformer 20 can be tuned by sliding the high-voltage winding 27 with respect to the low-voltage windings 22 and 22'. The width of the foil winding is now to be understood to be the sum of the widths $h22$ and $h22'$ of the low-voltage windings 22 and 22'. What is applicable to $h1$ and $h2$ in FIG. 1, is applicable to $h12$ and $h22$ plus $h22'$ in FIG. 2.

It was found that when the leg accommodating the low-voltage and high-voltage windings has a length exceeding the width of the foil winding increased by four millimeter, the coupling factor can already be properly adjusted.

It was also found that the length of the latter leg need not be larger than the sum of the widths of the foil winding and the high-voltage winding.

What is claimed is:

1. A high-voltage television line transformer tunable to a selected harmonic frequency of an input signal having a given frequency comprising, a ferromagnetic core including two yokes, two legs disposed between said yokes, at least one low-voltage foil winding disposed on one of the legs and adapted to receive said input signal, said foil winding having when energized substantially parallel magnetic field lines at its side and curved magnetic field lines at its end, and means for enabling tuning of said transformer to said selected frequency including a one high-voltage winding slidably disposed on the low-voltage winding, and wherein the length of the leg whereon the low-voltage winding and the high-voltage winding are disposed being substantially larger than the width of the foil winding and being less than the sum of the widths of the foil and high-voltage windings, thereby enabling the high-voltage winding to selectively engage the parallel and curved field lines.

2. A high-voltage transformer as claimed in claim 1, wherein the length of the latter leg exceeds the width of the foil winding by at least 4 millimeters.

* * * * *